US008261505B2

(12) United States Patent
Kalkanoglu et al.

(10) Patent No.: US 8,261,505 B2
(45) Date of Patent: Sep. 11, 2012

(54) SYNTHETIC SHINGLE OR TILE WITH STRESS RELIEF NAIL ZONES

(75) Inventors: Husnu M. Kalkanoglu, Swarthmore, PA (US); Gregory F. Jacobs, Oreland, PA (US)

(73) Assignee: CertainTeed Corporation, Valley Forge, PA (US)

( * ) Notice: Subject to any disclaimer, the term of this patent is extended or adjusted under 35 U.S.C. 154(b) by 526 days.

(21) Appl. No.: 12/444,425

(22) PCT Filed: Oct. 24, 2007

(86) PCT No.: PCT/US2007/082342

§ 371 (c)(1),
(2), (4) Date: May 20, 2009

(87) PCT Pub. No.: WO2008/052029

PCT Pub. Date: May 2, 2008

(65) Prior Publication Data

US 2010/0077689 A1 Apr. 1, 2010

Related U.S. Application Data

(60) Provisional application No. 60/862,858, filed on Oct. 25, 2006.

(51) Int. Cl.
*E04D 1/34* (2006.01)
*E04D 1/24* (2006.01)

(52) U.S. Cl. ..... 52/543; 52/518; 52/540; 52/547; 52/551; 428/223

(58) Field of Classification Search ..... 52/518, 52/533, 537, 547, 536, 542, 540, 520, 522, 52/528, 543, 546, 548, 551, 558, 559; 428/223
See application file for complete search history.

(56) References Cited

U.S. PATENT DOCUMENTS

| | | | | | |
|---|---|---|---|---|---|
| 1,473,275 | A | * | 11/1923 | Burgett | 52/536 |
| 2,117,092 | A | * | 5/1938 | Guiterman | 52/277 |
| 2,142,177 | A | * | 1/1939 | Clapp | 52/523 |
| 2,171,746 | A | * | 9/1939 | Guiterman | 52/523 |
| 2,522,067 | A | * | 9/1950 | Sperry | 52/470 |
| 2,830,546 | A | * | 4/1958 | Rippe | 52/522 |
| 3,190,040 | A | * | 6/1965 | Theobald | 52/420 |
| 4,010,590 | A | * | 3/1977 | Reinke | 52/533 |
| 4,712,351 | A | | 12/1987 | Kasprzak | |
| 5,729,946 | A | | 3/1998 | Beck | |
| 5,822,943 | A | * | 10/1998 | Frankoski et al. | 52/518 |

(Continued)

OTHER PUBLICATIONS

Inspire Roofing Products "Synthetic Slate General Information" Jul. 24, 2006. (5 pages).

*Primary Examiner* — Jeanette E. Chapman
(74) *Attorney, Agent, or Firm* — Paul & Paul

(57) ABSTRACT

A relatively rigid roofing shingle or tile is provided, having relatively flexible stress relief nail zones, that may comprise variations in thickness relative to the remainder of the shingle or tile, or variations in materials, such as will allow for relative movement of the shingles or tiles due to temperature variations resulting in expansion or contraction, or due to other forces, such that the movement will be between the shingles or the tiles and the nails or other fasteners that are used to secure the shingles or tiles to a roof or other surface, and is preferably within the elastic limits of the fastening zones of the shingles or tiles.

12 Claims, 7 Drawing Sheets

U.S. PATENT DOCUMENTS

| | | | | |
|---|---|---|---|---|
| 5,857,303 | A | 1/1999 | Beck et al. | |
| 5,887,403 | A | 3/1999 | Beck | |
| 5,979,135 | A | 11/1999 | Reeves | |
| 6,000,185 | A | 12/1999 | Beck et al. | |
| 6,134,855 | A | 10/2000 | Beck | |
| 6,955,019 | B2 | 10/2005 | Donlin et al. | |
| 6,990,779 | B2 * | 1/2006 | Kiik et al. | 52/554 |
| 7,670,668 | B2 * | 3/2010 | Greaves et al. | 428/142 |
| 7,836,654 | B2 * | 11/2010 | Belt et al. | 52/557 |
| 8,156,704 | B2 * | 4/2012 | Belt et al. | 52/557 |
| 2003/0040241 | A1 * | 2/2003 | Kiik et al. | 442/242 |
| 2004/0148874 | A1 * | 8/2004 | Jolitz et al. | 52/105 |
| 2006/0029775 | A1 | 2/2006 | MacKinnon | |
| 2006/0172643 | A1 * | 8/2006 | Greaves et al. | 442/136 |
| 2006/0179767 | A1 * | 8/2006 | Miller et al. | 52/555 |
| 2007/0042158 | A1 * | 2/2007 | Belt et al. | 428/143 |
| 2009/0293404 | A1 * | 12/2009 | Belt et al. | 52/525 |

* cited by examiner 75
78
74
77
76

81
80
79
82
83

89
85
84
87
86

90
93
88
99
91
92

95
98
94
97
100
96

102
101
104
105
103

107
106
110
108

113
112
111
114

120
116
115
118
121
117

124
123
122
125

130
127
126
131
129
128

134
133
132
135

130
127
126
128
131
129

135'
133'
132'
134'
136'
137'

141
138
139
140
142
143

146
148
144
149
145
147
150

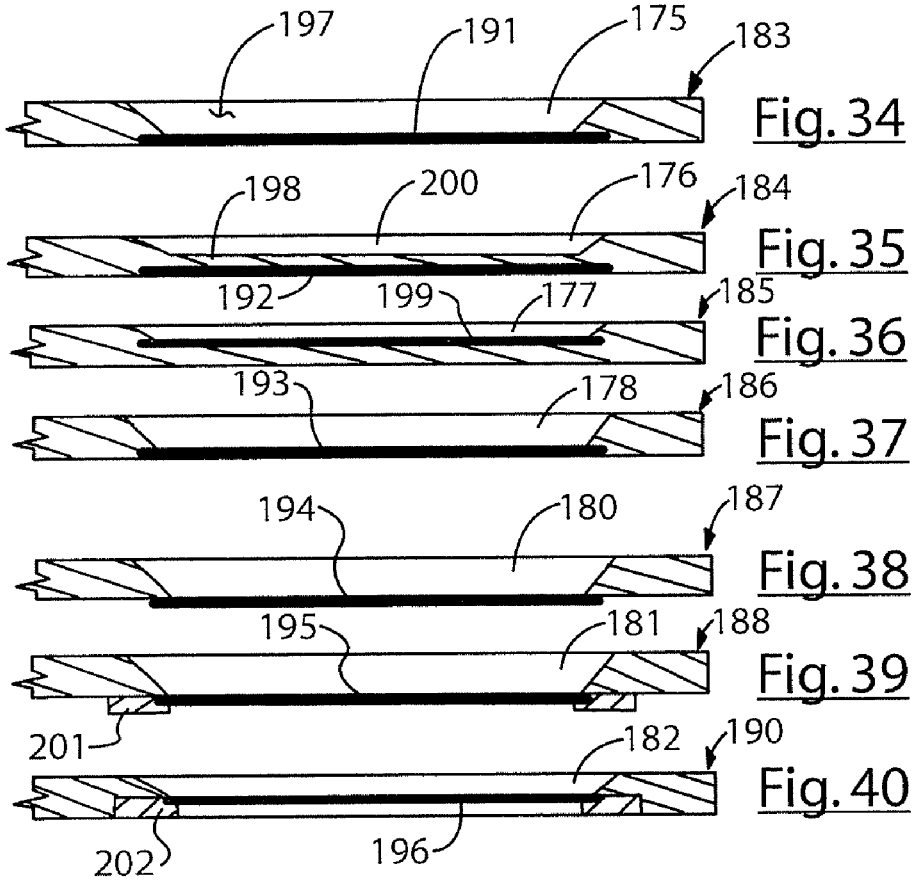
197
191
175
183
Fig. 34
198
200
176
184
Fig. 35
192
199
177
185
Fig. 36
193
178
186
Fig. 37
194
180
187
Fig. 38
195
181
188
Fig. 39
201
182
190
Fig. 40
202
196
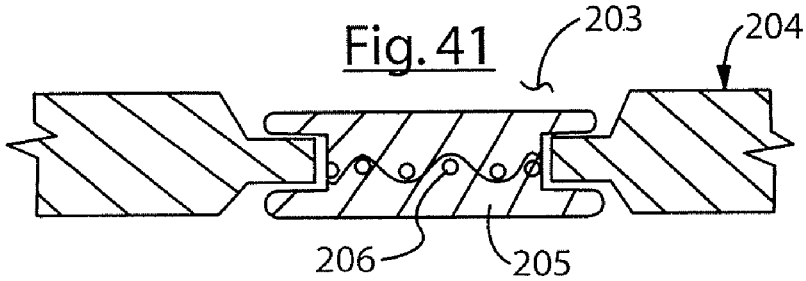
Fig. 41
203
204
206
205

SYNTHETIC SHINGLE OR TILE WITH STRESS RELIEF NAIL ZONES

CROSS-REFERENCE TO RELATED APPLICATIONS

This application claims the priority from PCT/US07/82342 filed Oct. 24, 2007 which in turn claims the priority of U.S. Ser. No. 60/862,858 filed Oct. 25, 2006.

BACKGROUND OF THE INVENTION

Polymeric synthetic roofing shingle or tile products can be subject to thermal expansion and contraction when exposed to varying temperatures. Such thermal expansion and contraction can lead to forces imposed on the fastening points of the roofing product where the roofing product is attached to the roof. In some instances the forces may be large enough that over repeated temperature changes during use, the shingle fasteners may become dislodged from the roof, or the movement of the shingle may lead to the development of stress cracking in the nailing zones and damage to the shingle or tile body.

THE PRESENT INVENTION

This invention is a synthetic roofing shingle or tile, especially a synthetic slate shingle, having nail zones that include stress relieving structures. The invention is also a method of relieving stress in the nail zone of a synthetic polymer building material and a method of making a synthetic roofing shingle having a stress relieving nail zone. In some embodiments, the invention is a synthetic roofing shingle having a supported nail zone.

The stress relief nail zone acts as a spring to allow local movement in the product as loading forces are encountered over time. Forces of thermal expansion and contraction are dissipated by the nail zones of the invention and movement of the product is accommodated without dislodgement of fasteners.

SUMMARY OF THE INVENTION

This invention provides relatively flexible (within their elastic limits) nail zones for relatively rigid synthetic polymer based roofing shingles or tiles, especially those of the synthetic slate type, that assist in relief of stress in such products at fastening points. Forces of thermal expansion and contraction are dissipated by the nail zones of the invention. Movement of the product is accommodated without dislodgement of fasteners. Structures are provided that can assist in nail positioning for hand-nailed applications. Target zones are provided for power-nailing installations as with a nail-gun. In some embodiments support is provided under the nailing zone to allow tight fastening to a roof deck.

BRIEF DESCRIPTIONS OF THE DRAWING FIGURES

FIGS. 34-40 are transverse sectional views of various shingles or tiles, having different nail zone arrangements. with the illustrations of FIGS. 34-40 being taken through fragmentary portions of shingle or tiles along section lines similar to that I-I of FIG. 3.

FIG. 41 is a transverse sectional view, taken through a fragmentary portion of a shingle or tile in accordance with this invention, illustrating yet another alternative form of nail zone arrangement.

DETAILED DESCRIPTIONS OF THE PREFERRED EMBODIMENTS

It will be understood that, as used throughout this specification, the words "shingle", and "tile" are used interchangeably, and in some cases are referred to as "slate", or "synthetic slate", or "synthetic shake", all intended to be without limitation. Also, as used throughout herein, the term "nailing zone" is intended to apply in the broadest sense, to include any type of fastening zone, whether it be for a nail, staple or the like. Because roofing products have conventionally been applied via nails, the zones of the shingles or tiles through which fasteners are applied have conventionally become referred to as "nail zones", although it will be understood that any type of suitable fastener may be used, and will fall within the scope of "nail zone" or "nailing zone" as used herein.

Figure 1:
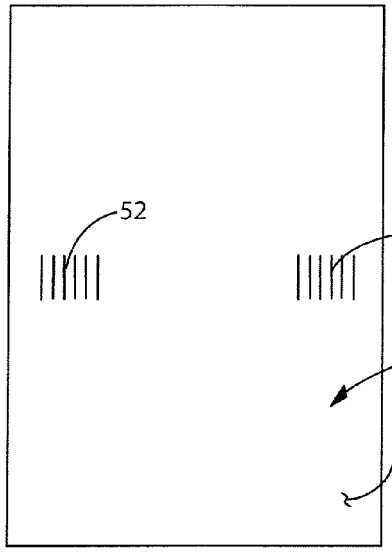
FIG. 1 shows a top view of a synthetic shingle or tile having a certain configuration for its nail zones, in accordance with the invention.
Figure 2:
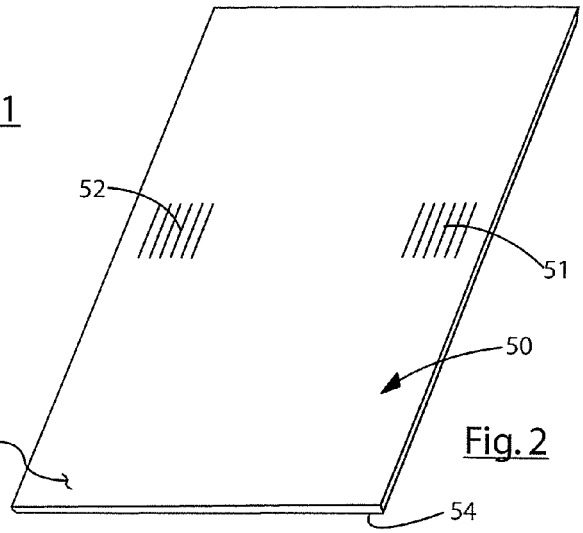
FIG. 2 shows a top perspective view of the shingle or tile of FIG. 1.
Figure 3:
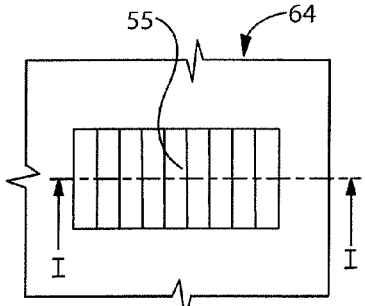
FIG. 3 shows an enlarged fragmentary illustration of a shingle or tile having an alternative nail zone to that shown in FIGS. 1 and 2.

In FIGS. 1 and 2, a synthetic roofing product 50 is shown having two nail zones 51 and 52. The drawings shown can represent either the top or the bottom, or both the top and bottom of a given tile or shingle, simulating slate or other material. The nail zones are depicted as a series of lines indicating variable thicknesses of material. The thinner zones allow for deformation of material as a nail or other mechanical fastener passes through the shingle to attach it to a roof. The variable thicknesses can act as springs to allow movement of the product 50 via a "stretching" of a nail zone portion of the product within its elastic limit, meaning that after applied stresses are removed, the stretched nail zone portion of the product will return to its unstretched, original configuration or shape. The spring-like structure can be molded or formed into the top surface 53, or the bottom surface 54, or both the top and bottom surfaces 53, 54 of the shingle or tile 50. In some embodiments the stretched nail zone portion may undergo plastic or permanent deformation, relieving stresses imposed by immobilization of a portion of the roofing product by the fastener.

Figure 4:
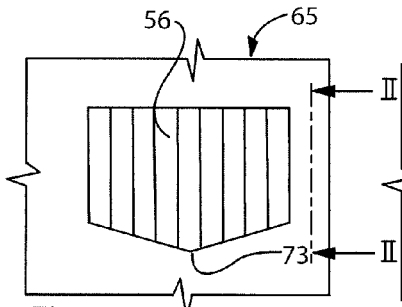
FIG. 4 is an illustration like that of FIG. 3, but having yet another alternative configuration for a nail zone.
Figure 5:
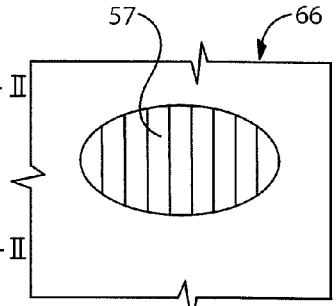
FIGS. 5 through 10 are a number of illustrations like that of FIG. 3, but having yet other alternative configurations for nail zones.
Figure 6:
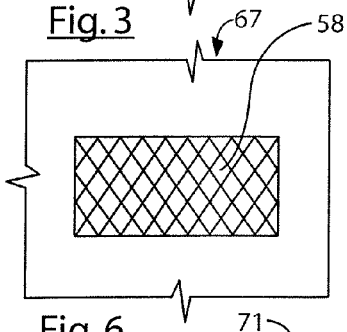
Figure 7:
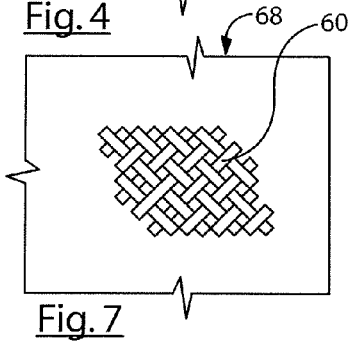
Figure 8:
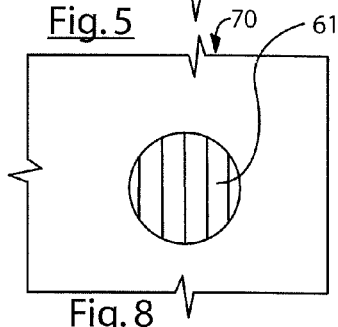
Figure 9:
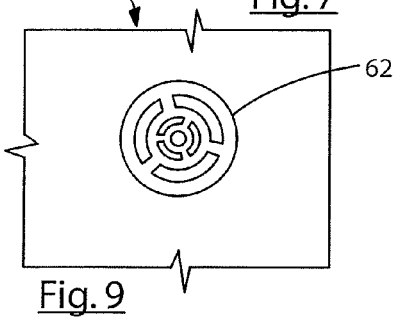
Figure 10:
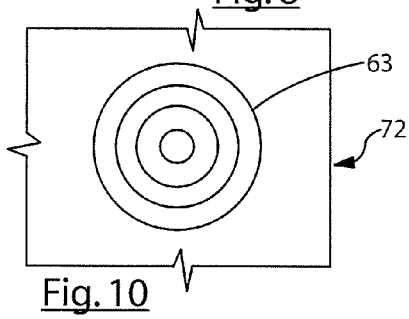

In FIGS. 3-10, a variety of configurations 55, 56, 57, 58, 60, 61, 62 and 63 are provided, for ripples or surface texture, for their respective shingles or tiles 64, 65, 66, 67, 68, 70, 71 and 72. The overall shapes of the nail zones can take on any of various configurations, as FIGS. 3-10 demonstrate. FIG. 4, for example, shows a shape that could have a drainage point 73 for the nail zone if the structure is included in the top surface of the shingle. The shapes of the nail zones can include thickness variations or can include undulations or shapes of similar or different thicknesses to effect, in each case, a spring-like force dissipater in the nail zone 56. The shapes can have lateral or horizontal components to their designs. They can also include radial components. In the case where thickness is varied in the nail zone, there can be regions of very thin material, and, there can even be portions of the nail zone where there are passages passing through the plane of the shingle.

FIGS. 11-26 illustrate a variety of sectional views of alternative embodiments of nail zones for synthetic shingles or tiles according to the invention. For the most part, the nail zones are comprised of corrugations, and as shown, indicate changes in thickness or changes in the elevations of upper or lower surfaces across the nail zones from left to right. These changes can take the form of ridges or ribs, or can even be alternative regions with substantially little amounts of material alternating with regions where there is sufficient material to allow fastening of the shingle or tile to a roof surface. Essentially, the drawings of FIGS. 11-26 show nail zone structures as a series of ridges throughout the nail zones.

Figures 11, 12, 13, 14, 15, 16, 17, 18, 19, 20, 21, 22, 23, 24, 25, 26:
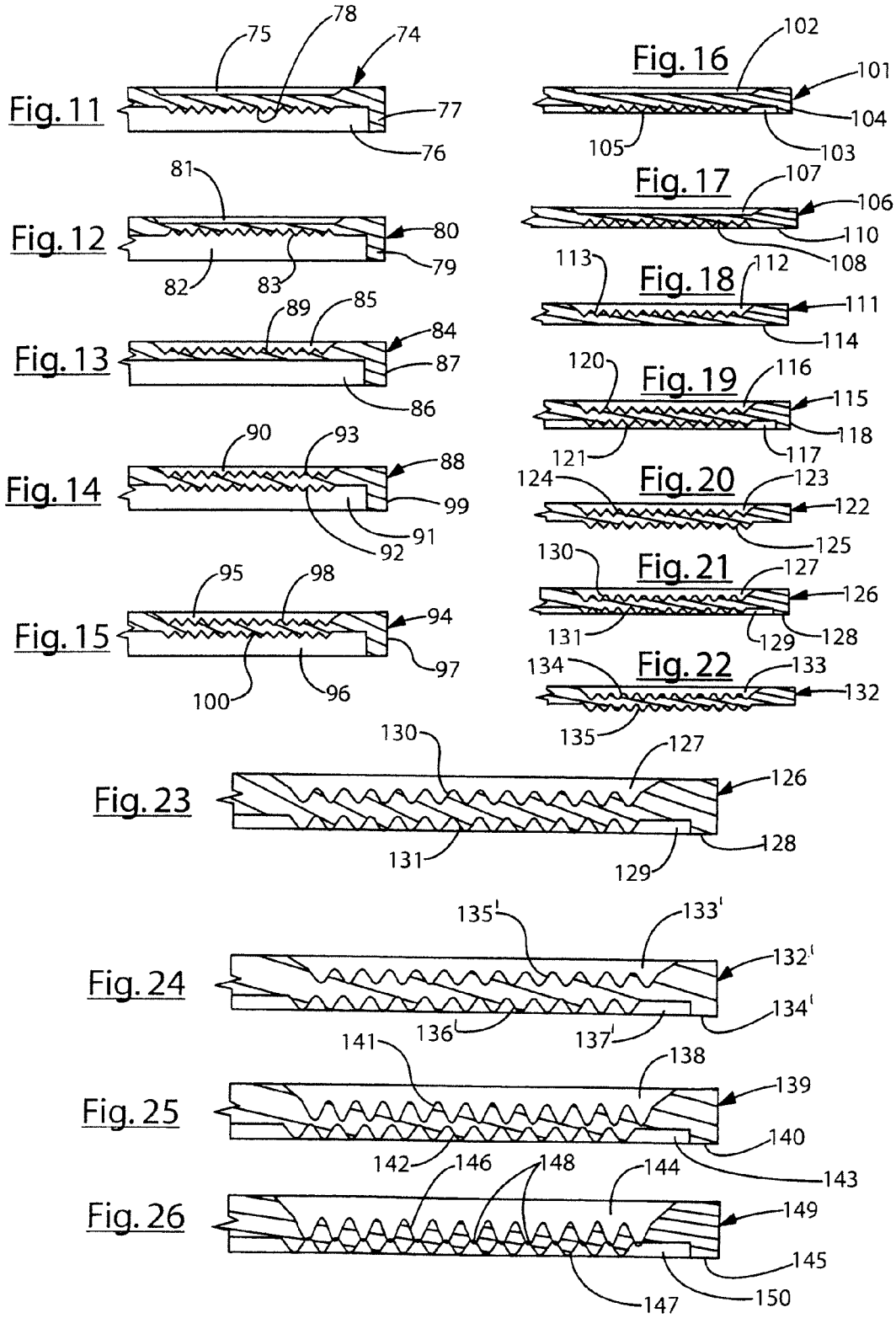
FIGS. 11 through 26 illustrate shingles or tiles of this invention having various arrangements of nail zone configurations, illustrated in transverse cross-sections, taken through nail zones of shingles or tiles, along lines similar to cross-sectional line I-I of FIG. 3, in each case, with the left sides of the illustrations being fragmentally illustrated, as shown.

In the sectional drawings of FIGS. 11-26, the textures can be on the tops or bottoms of the nail zones, or on both the tops and bottoms of the nail zones. In FIGS. 13 and 18 for example, the ridges are on the tops. In FIGS. 11, 12, 16 and 17, the ridges are on the bottoms. In FIGS. 14, 15, 19, 20, 21 and 22, the textures or ridges are on both the tops and bottoms of each of the nail zones.

FIGS. 21-26 represent more rounded, wavy undulations in the structures, whereas FIGS. 11-20 have more sharply ridged nail zone structures.

FIG. 21 (also shown in larger illustration in FIG. 23) illustrates rounded wavy structures having waves synchronized on the top and bottom such that the thickness across the nail zone is substantially constant. FIG. 24 shows the thickness pattern offset by 90 degrees so that the peaks and valleys coincide such that the valleys of the upper pattern align with peaks of the lower pattern, resulting in variations in thickness from a maximum to a minimum. FIG. 25 shows a more extreme amplitude for the upper pattern resulting in thinner sections between the ridges. FIG. 26 shows a structure where the pattern is such that the ridges appear as small rods in the nail zone to hold the nail, with gaps therebetween through which the nail may pass.

Thus, the sectional drawings of FIGS. 11-26 depict an array of lines or ridges for the patterns and show in each case a single section through the nail zone. If the nail zone were to take on a different pattern such as one of those exemplified in FIG. 6, 7, 9 or 10, for example, the sectional view may have a slightly different appearance, but would still function similarly.

The embodiments of FIGS. 11-15 each show sections of shingles where the backs are hollowed out and the nail zones are located above the substrate levels to which the shingles would be applied. FIGS. 16, 19 and 21 illustrate embodiments of shingles that have backs that are hollowed out and have their nail zones descending downwardly from the bottom surfaces of the shingles, to come into contact with the surfaces to which the shingles would be applied. Such hollowed out shingles may include ribbed structures that may provide stiffening to the main bodies of the shingles, while allowing the use of lesser quantities of material. Such ribs may optionally be such that they extend downwardly from the lower surfaces of the bottoms of the shingles to have at least some contact points, or full contact with the substrate to which the shingles are to be applied, so as to provide some support to the shingles in the event that they experience loading forces, such as, for example, foot traffic. FIGS. 20 and 22 illustrate shingles where the nail zone structures provide the contact points for fastening the shingles to a substrate. FIGS. 17 and 18 illustrate substantially flat shingles, the bottoms of which are not hollowed out, that also include the nail zones of the invention. FIGS. 16 through 22 illustrate nail zones that provide direct support to the shingles, avoiding downward deflections of the nail zones that might otherwise occur by fasteners passing through the nail zones to attach the shingles to roof substrates.

Thus, in FIG. 11 shingle 74 has an upper recess 75, a lower recess 76, a rib 77 for supporting the shingle on a roof, and downwardly-facing ribs or corrugations 78.

The shingle 80 of FIG. 12 has an upper recess 81, a lower recess 82, a rib 79 for support on a roof, and downwardly facing ribs or corrugations 83.

Shingle 84 of FIG. 13 has upper and lower recesses 85 and 86, a supporting rib 87, and upwardly facing ribs or corrugations 89.

Shingle 88 of FIG. 14 has upper and lower recesses 90 and 91, a supporting rib 99, and upper and lower ridges or corrugations 93 and 92, respectively.

The shingle 94 of FIG. 15 has upper and lower recesses 95 and 96, respectively, a depending rib 97 for support against a roof, and upper and lower ridges or corrugations 98, 100, respectively.

The shingle 101 of FIG. 16 has upper and lower recesses 102 and 103, respectively, a supporting rib 104, and downwardly facing ridges or corrugations 105.

The shingle 106 of FIG. 17 has an upper recess 107, supporting surface 110 for support against a roof surface, and downwardly facing ridges or corrugations 108.

The shingle 111 of FIG. 18 has an upper recess 112, a lower supporting surface 114 like that 110 of FIG. 17, and upwardly facing ridges or corrugations 113.

The shingle 115 of FIG. 19 has upper and lower recesses 116, 117, respectively, a downwardly facing support rib 118, and both upper and lower ridges or corrugations 120 and 121, respectively.

The shingle 122 of FIG. 20 includes an upper recess 123, and upper and lower ridges or corrugations 124, 125, respectively.

The shingle 126 of FIGS. 21 and 23 has upper and lower recesses 127, 129, respectively a downwardly facing supporting rib 128, and upper and lower ridges or corrugations 130 and 131, respectively.

The shingle 132 of FIG. 22 has an upper recess 133, and upwardly and downwardly facing ridges or corrugations 134 and 135 respectively, as shown.

The shingle 132' of FIG. 24 has upper and lower recesses 133' and 137' respectively, a downwardly facing supporting rib 134', and upper and lower ridges or corrugations 135' and 136', respectively.

The shingle 139 of FIG. 25 has upper and lower recesses 138 and 143 respectively, a downwardly facing supporting rib 140, and upper and lower ridges or corrugations 141, 142.

The shingle 149 of FIG. 26 includes upper and lower recesses 144 and 150 respectively, a downwardly facing supporting rib 145, upper and lower facing ridges or corrugations 146 and 147, and intersections of the ridges 146, 147 that appear as small rods 148, to hold the nail, with gaps therebetween through which the nail may pass.

Figure 27:
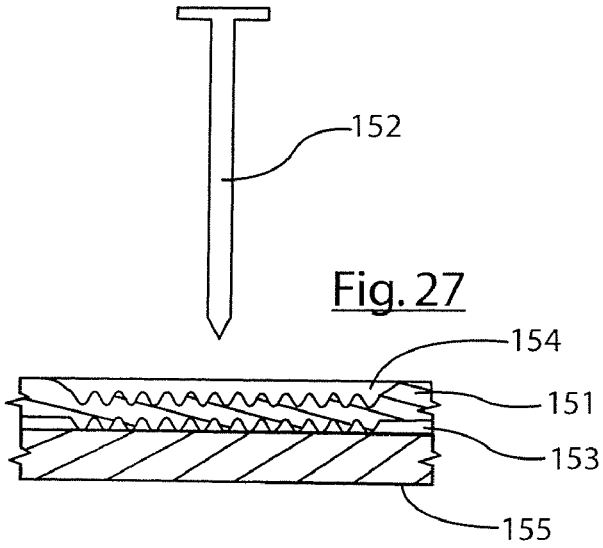
FIGS. 27 through 29 are fragmentary cross-sectional illustrations, taken through a nail zone of a shingle or tile that is laid up on a roof, showing different stages of nailing the shingle or tile through its nail zone, to a roof.
Figure 28:
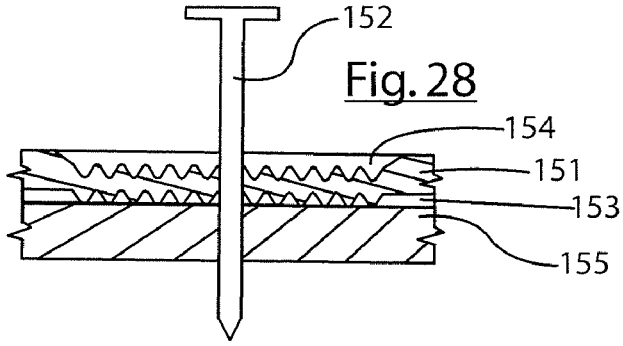
Figure 29:
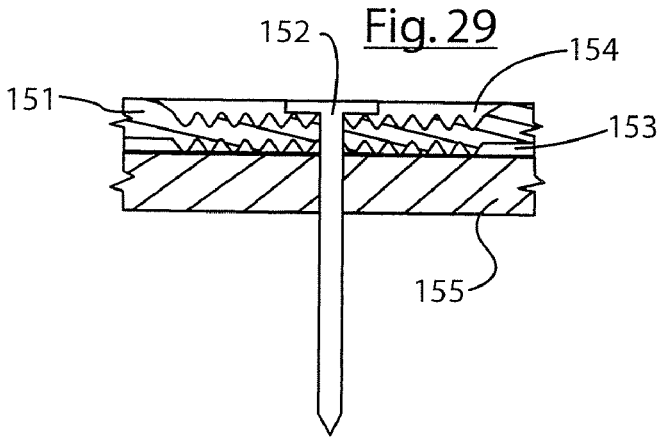

FIGS. 27-29 illustrate a series of steps, whereby a fastener 152, such as, for example, a nail, is passed through the nail zone of a shingle 151, to attach the shingle to a roof substrate 155.

It will be seen, in the progressive illustrations of FIGS. 27-29, that the shingle 151 is slightly hollowed out in the vicinity of the nail zone, both at its upper surface 154, and at its lower surface 153, and that the nail zone's lower surface has a structure that contacts the substrate 155, substantially throughout the attachment processes. The upper surface of the nail zone has a texture that can assist in locating a nail approximately in a desirable position, in the event of a hand-nailing operation. It will also be noted that the upper surface of the nail zone in each case is slightly recessed at 154 so that the nail, when fully mounted through the shingle into the roof substrate 155, is substantially flush with, or slightly below the top surface of the shingle.

Figure 30:
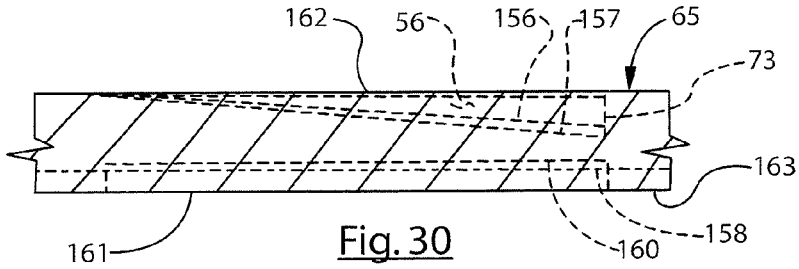
FIG. 30 is an enlarged fragmentary sectional view, taken through the portion of the shingle or tile illustrated in FIG. 4, generally along the line II-II of FIG. 4.

With reference to FIG. 30, it will be seen that the shingle 65 (also illustrated in FIG. 4), is an embodiment of a nail zone from the side, as shown in FIG. 4. The phantom lines 156, 157 illustrate an angled recess 56 in the texture of the upper surface of the nail zone, providing a taper in the depth of the nail zone from left-to-right as shown in FIG. 30, such that the nail zone is recessed to a greater extent at the right end thereof, which is the end that is closer to the upper end of the shingle, and shallowest at the lower end of the recess, which is the left end as viewed in FIG. 30 so that any moisture entering the recess 56 of the nail zone may be directed out of the nail zone, toward the lower end of the shingle.

In the illustration of FIG. 30, the two tapered phantom lines 156, 157 in the nail zone, indicate that there is a surface texture that is corrugation-like, that may contribute to stress relief in the nail zone. The phantom lines 158, 160 at the bottom of the nail zone of the shingle 65 of FIG. 30 indicate a corrugation-like texture thereof, for stress relief, and show it to be variable in depth, with the depth traversing the plane of the bottom surface 161 of the shingle 65 in the general area of the nail zone 162 thereof. A downwardly facing supporting rib 163 is provided, to provide support of the nail zone against the substrate, when the shingle is fastened thereto with a mechanical fastener, such as a nail, staple or the like.

Figure 31:
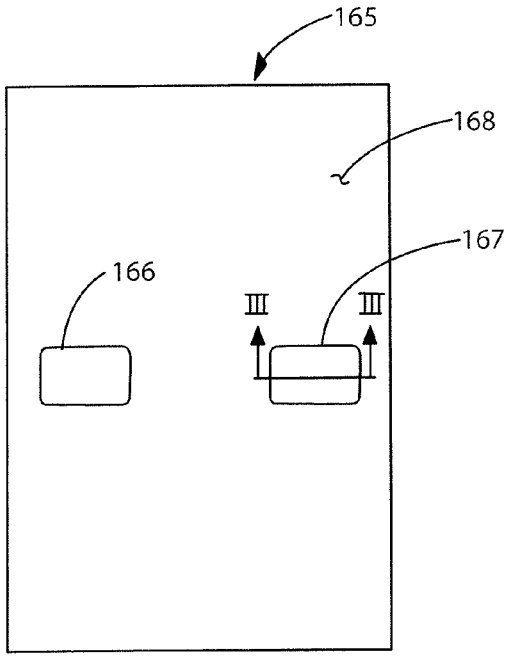
FIG. 31 is a top view of an alternative shingle or tile in accordance with this invention, having another alternative type of nail zone.

In FIG. 31, another shingle, tile or the like 165 is illustrated, in top view, having nail zones 166 and 167. The shingle or tile 165 has a top surface 168.

Figure 32:
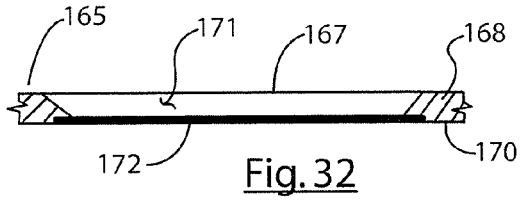
FIG. 32 is an enlarged fragmentary transverse sectional view, through the shingle or tile of FIG. 31, taken along the line III-III of FIG. 31.
Figure 33:
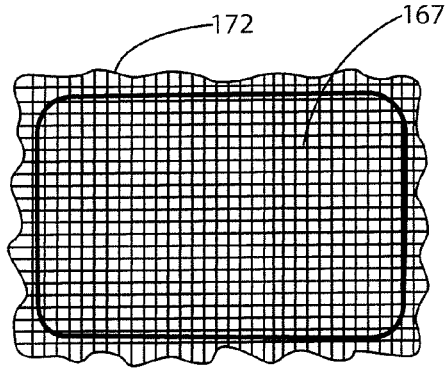
FIG. 33 is a fragmentary bottom view of the portion of the shingle or tile of FIG. 32, with its nail zone shown in outline.
Figure 42:
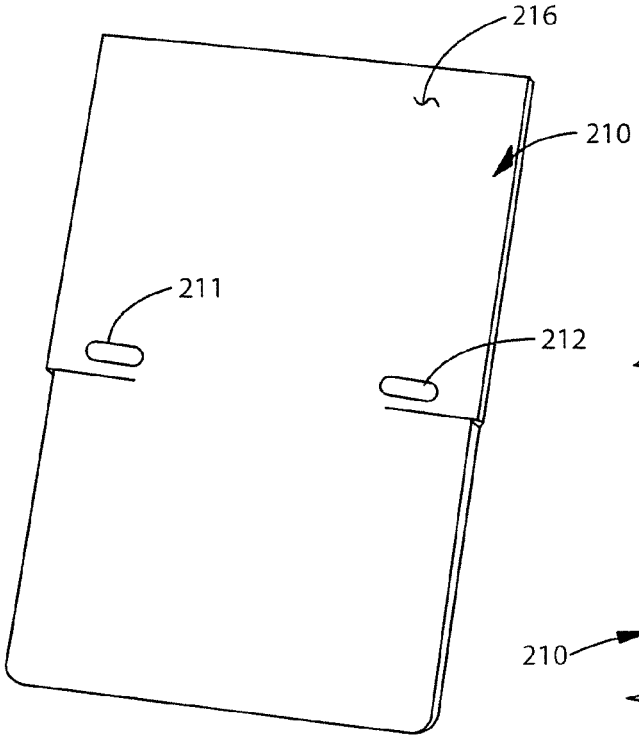
FIG. 42 is a top perspective view of a shingle or tile in accordance with this invention, having a different form of nail zone configuration.

FIG. 32 fragmentally shows the shingle or tile 165 of FIG. 31, in sectional view, along line III-III of FIG. 31, with its nail zone 167 including an upper recess 171, between upper and lower surfaces 168, 170. The nail zone 167 includes a reinforcing web 172 on its lower surface 170, traversing the same. The web 172 may be comprised of a glass or polymeric or other material, or a combination thereof. The web 172 can be woven, non-woven, a scrim material, or a combination thereof. The web 172 can be attached to the nail zone to provide reinforcement. For example, it can be laminated to the nail zone by being placed in a mold in a region of the nail zone of the shingle precursor prior to closing the mold and molding according to the processes described in US publication 2006/0029775, the complete disclosure of which is herein incorporated by reference. The nail zone 167 can comprise substantially the reinforcing web, such as in the material in the nailing hem for siding panels disclosed, for example, in U.S. Pat. Nos. 5,979,135 and/or 5,857,303, the complete disclosures of which are herein incorporated by reference. Alternatively, the fabric could be laminated to the body of the shingle at the nail zone, or encapsulated within a polymeric layer at the nail zone.

FIGS. 34-40 illustrate a number of different forms of nail zones 175, 176, 177, 178, 180, 181 and 182 for respective shingles or tiles 183, 184, 185, 186, 187, 188 and 190, which include respective webs 191, 192, 193, 194, 195 and 196. In FIG. 34, the web 191 may be comprised of a polymeric composition making up the nail zone area 175, beneath a recessed area 197. In FIG. 35, the web 192 may be located in the nail zone 176, beneath a thin-walled section 198 of the shingle or tile, beneath a recess 200 therein, embedded in the polymeric construction of the shingle or tile 184. In the illustration of FIG. 36, the web 199 may be located near the top surface of the nail zone 177 and within the polymeric or other material comprising the shingle or tile 185.

In the illustration of FIG. 37, the recess 178 that comprises the nail zone may cover an entire opening in the nail zone, and the web 193 may cover that opening, being attached to the shingle or tile, in the polymeric or other material at the perimeter of the nail zone, as shown, near the bottom surface thereof.

In the embodiment of FIG. 38, the shingle 187 may have an opening 180 that exists from top to bottom, with the web 194 covering that opening and being attached to the bottom of the shingle at the periphery at that nail zone.

In the embodiment of FIG. 39, the shingle 188 may have an opening throughout the nail zone 181, and the web 195 may cover that opening along its bottom, being attached to the shingle at the perimeter of the nail zone by an additional securing member 201 about the perimeter thereof.

In the illustration of FIG. 40, the shingle or tile 190 may have an opening that comprises its nail zone 182, from the top to the bottom of the shingle 190, and have a web 196 that closes that opening, and is secured thereto, about its perimeter, by means of an additional securing member 202, as shown. Such additional securing members 201 and 202 may include polymeric materials that may or may not be softer, less rigid and more rubber-like, adhesively secured to the shingles or tiles, or vulcanized thereto, or heat sealed to the relatively rigid shingle bodies, compatible with securing the webs to the shingle bodies. In the embodiment of FIG. 40, the web is secured to the shingle body and is slightly elevated from the lower surface of the shingle body.

With reference to FIG. 41, a different form of flexible presence in a nail zone 203 may be provided for a shingle or tile 204, in the form of a grommet-like structure 205, that may or may not have web or fabric-like reinforcement 206 therein, with the grommet-like structure 205 being otherwise rubber-like, being more flexible than the material of construction of the shingle or tile 204 itself such that when a fastener may be driven through the grommet-like structure 205, subsequent lateral movement of the shingle or tile 204 may be accommodated by the elastomeric nature of the grommet-like structure 205, to accommodate the lateral movement of the shingle, within the elastic limit of the grommet-like structure 205.

With reference now to FIGS. 42-45, it will be seen that a shingle 210 is provided, having fastening or nailing zones 211 and 212, for receipt of nails, staples, or other fasteners 213 therethrough, for fastening shingles 210 to a roof structure 219.

Figure 43:
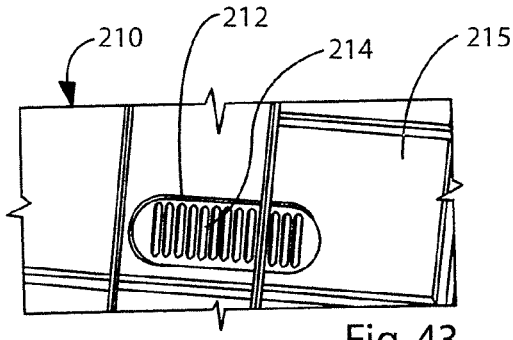
FIG. 43 is an enlarged fragmentary illustration of one of the nail zones of the shingle or tile of FIG. 42, taken from the bottom thereof.
Figure 44:
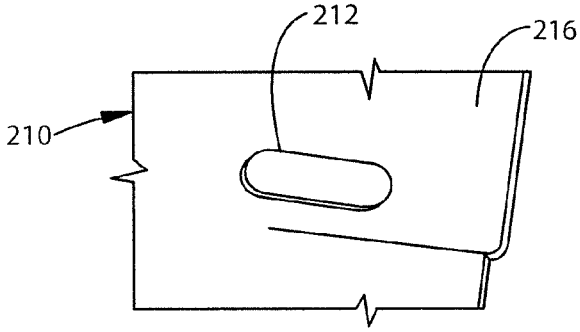
FIG. 44 is an enlarged fragmentary top perspective illustration of a portion of the shingle or tile illustrated in FIG. 42, further illustrating the nail zone configuration of FIG. 42.

With specific reference to FIGS. 43 and 44, it will be seen that the nailing zones 211, 212, may, if desired, have ribs or corrugations 214 visible from the undersurface 215 of the shingle or tile 210, in the vicinity of the nail zones 211 or 212, and that the nail zones, for example 212 illustrated in FIG. 44 may be of reduced thickness, to be shallower than the upper surface 216 of the shingle or tile. In the embodiments of FIGS. 43 and 44, the ridges or corrugations 214 are shown only in the lower surface, but it will be understood that the same could be in the upper surface as well, if desired.

Figure 45:
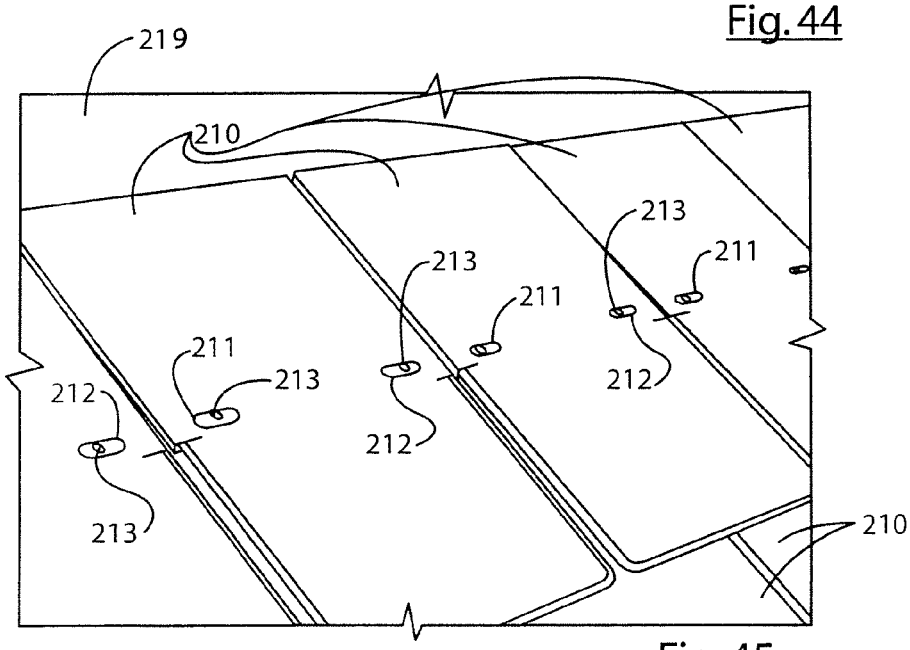
FIG. 45 is a fragmentary illustration of a portion of a roof having courses of the shingles or tiles illustrated in FIG. 42 applied to the roof.

With specific reference to FIG. 45, it will be seen that the synthetic shingles or tiles are laid up in courses, with lower or tab portions of a next-overlying course overlying headlap or butt portions of the shingles or tiles in a next-underlying course, all as shown in FIG. 45.

Figure 46:
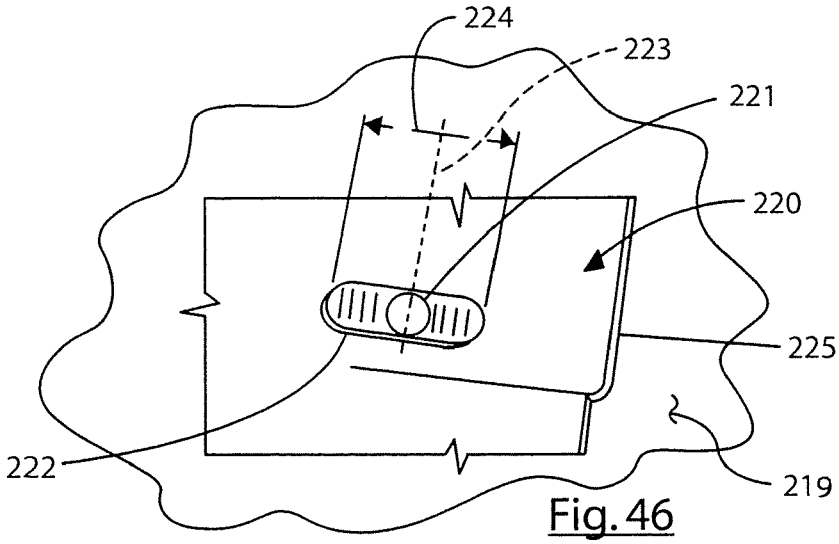
FIG. 46 is a fragmentary top perspective illustration of a portion of a shingle or tile illustrated in FIG. 45, applied to a roof with a nail or other fastener, prior to leftward or rightward movement of the shingle or tile due to thermal expansion or contraction thereof.

With reference to FIG. 46, a shingle or tile 220 is illustrated, having a nail-type fastener 221 passing through the nail zone 222 thereof, from top to bottom, to secure the shingle or tile 220 to a roof fragmentally shown at 219. The placement of the nail or other fastener 221 is shown as being generally centrally located, along the approximate centerline 223 of the nail zone 222, with the nail zone being generally elongated between right and left edges of the shingle 220, as shown an amount 224, to allow for leftward or rightward movement of the shingle or tile 220 relative to the fastener 221, which will generally be fixably located when applied to a roof.

As a laid-up array of shingles 210 in a given course, as shown in FIG. 45, is subjected to substantial variations in temperature, adjacent shingles may be moved relative to each other, by having their edges 225 press against one another, causing lateral movement of shingles.

In order to accommodate such lateral movement, the spring-like effect provided by variations in thickness, corrugations or the like, as is discussed hereinabove, will allow for lateral movement of the shingles 220, within the elastic limit of the structures of the nail zones without causing shingle breakage.

Figure 47:
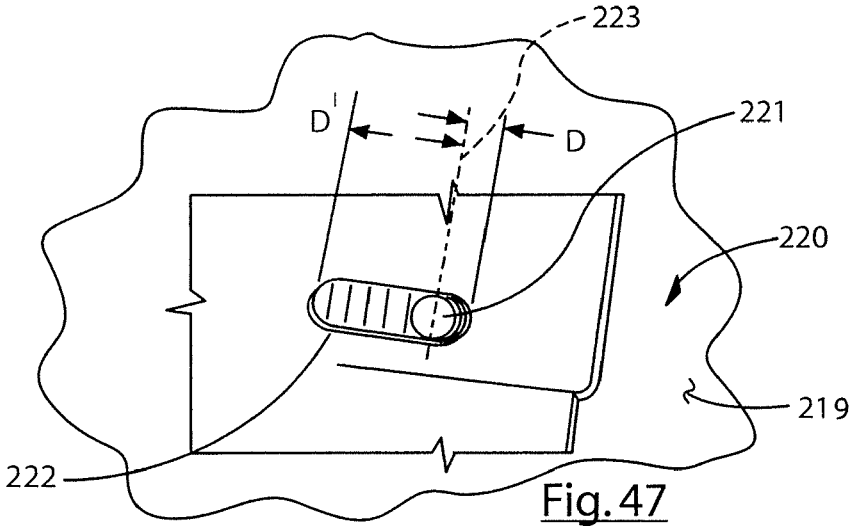
FIG. 47 is an illustration similar to that of FIG. 46, but wherein leftward movement of the shingle or tile relative to the nail or other fastener is illustrated, due to thermal expansion or contraction of the shingle or tile.

For example, with reference to FIG. 47, it will be seen that the shingle 220 has been moved leftward relative to its nail 221, so that the centerline 223 of the nail placement has been moved closer to the right edge of the nail zone 222 than previously shown in FIG. 46, so that the nail 221 is closer to the right edge of the nail zone as shown by the amount D, rather than the larger spacing D' shown for the placement of the nail 221 relative to the left edge of the nail zone 222 as shown in FIG. 47.

Figure 48:
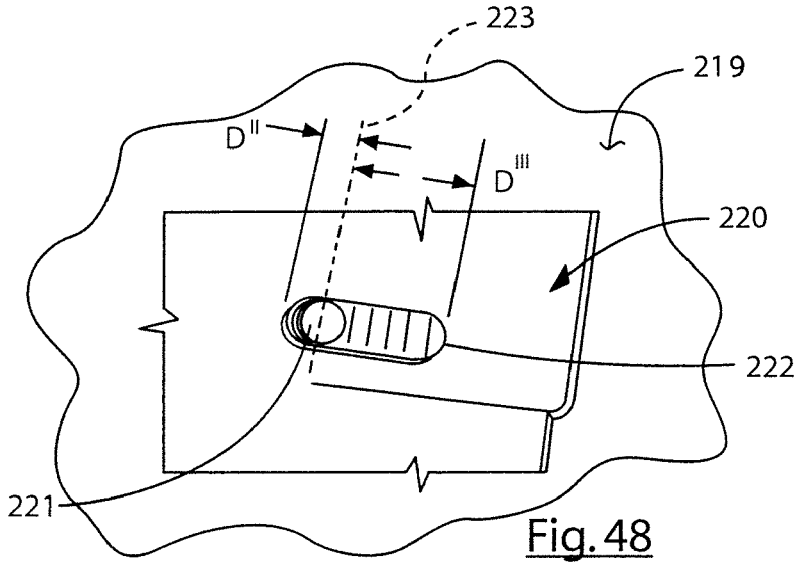
FIG. 48 is an illustration similar to that of FIG. 47 but wherein rightward movement of the shingle or tile relative to the nail or other fastener is illustrated, due to thermal expansion or contraction of the shingle or tile.

With reference to FIG. 48, the opposite is illustrated relative to that 47, whereby rightward movement of the shingle or tile 220 relative to the nail or other fastener 221 has occurred, such that the nail 221 is closer to the left edge of the nail zone 222, an amount D" relative to the centerline 223 of the nail, such that the location of the nail 221 is much more greatly spaced from the right edge of the nail zone 222 an amount represented by D'''.

It will be understood that all such relative movements between the nails or other fasteners and the shingles or tiles, within the nail zones, are within the elastic limit of the nail zone as allowed by the corrugations, relative thicknesses or thinnesses of materials, the materials themselves, etc. In some instances a degree of plastic deformation can occur without detrimental effect to the roofing installation.

Nail zones of the invention operate with the shingles and fasteners analogously to bridge dampers where one end of a structure is securely connected and another portion of the structure is more loosely connected in a floating arrangement such that the attachment between the shingle and the roof by way of the fastener can account for expansion and contraction of either one or both of the shingle and the roof.

Nail zones are sized such that they can be conveniently targeted and hit using a nail gun in shingle installation. Preferred nail zones would be on the order of about ¾ inch to 2 inches in width, with a preferred width being about 1 to 1½ inches. Preferred heights of nail zones would be on the order of about ½ inch to 1½ inch.

In the case of molded spring type nail zones, a preferred thickness is about ⅓ of the thickness of the synthetic slate or shake shingle or tile, although it could be somewhat thinner or thicker. For molded spring type nail zones, the preferred frequency of the pattern across the nail zone is approximately 5 to 15 lines per inch with a more preferred frequency of about 10 lines per inch for the stress relieving spring pattern. Synthetic shingles employing the nail zones of the invention may be based on polymeric materials and can be comprised of multiple layers of different materials, as may be desired. Preferred polymeric materials are thermoplastic materials, but thermoset materials could also be used. In some such shingles, recycled polymer content may be employed. Examples of suitable polymeric materials would include, but not be limited to, polyethylene material, a polypropylene, a polymethylpentene, a polybutene, a polyacrylate, a polyvinylchloride, or blends of various synthetic polymers, all as may be desired. Such synthetic shingles or tiles could also be comprised of ceramic materials or fiber cement materials (ie, cement-like materials having fibers therein). The polymeric or other materials may comprise not only the nail zones of shingles or tiles, but the shingles or tiles themselves. In some instances, where shingles or tiles are made of fiber cement, ceramic, metal or wood, the nail zones could be comprised of polymeric materials. Exemplary shingles using such stress relief zones may be made using processes as described in U.S. 2006/0029775. Appropriate mold fixtures or inserts could be employed to form the stress relief zones.

The stress relief zones as described in the figures hereof can be constructed of the same relatively rigid (like slate or tile) synthetic slate material as is the rest of the shingle or tile, or can be constructed of softer relatively flexible, more rubber-like materials that are adhesively secured to the remainder of the synthetic shingles, vulcanized thereto, or otherwise inserted therein in the manner of a grommet or the like as shown in FIG. 41 in a relatively rigid shingle body, such as will allow for movement in the nail zone or other fastener zone, as may be desired. Such stress relief zones can optionally also include a webbing or like embedded reinforcement of strands or the like, to provide strength in the zones in which nails or other fasteners are to be applied.

It should now be appreciated that the practice of the present invention provides for a nail zone and a method of forming a nail zone that may serve as a stress relieving means or local support for a relatively rigid shingle, shake, tile or the like that is intended to be placed onto the exterior of a building structure or roof. It will be appreciated by those skilled in the art that changes and modifications may be made to the above described embodiments without departing from the inventive concept thereof. It is understood, therefore, that the present invention is not limited to particular embodiments disclosed, but is intended to include all modifications and changes which are within the scope and spirit of the invention as defined in the appended claims.

What is claimed is:

1. A synthetic roofing element of a shingle or tile type comprising:

(a) top and bottom surfaces;

(b) a headlap portion and a tab portion between the top and bottom surfaces;

(c) the headlap portion being adapted to have its top surface generally covered in the installed condition of the element on a roof, and the tab portion being adapted to have its top surface generally uncovered and weather-exposed in the installed condition of the element on a roof;

(d) the element having a periphery defined by upper, lower, right and left edges;

(e) the element being essentially principally comprised of a relatively rigid construction;

(f) at least one element fastening zone in the headlap portion;

(g) the at least one element fastening zone being disposed inside the element periphery and indented in at least one of said top and bottom surfaces, completely surrounded by unindented portions of said element, for receiving a fastener therethrough for fastening the element to a roof;

(h) said fastening zone having fastening zone top and bottom surfaces, with at least a portion of the element fastening zone being comprised of a relatively flexible construction, relative to said relatively rigid construction and having a plurality of ridges on at least one of said fastening zone top and bottom surfaces;

(i) whereby said relatively flexible construction of the fastening zone of clause (h) relative to the relatively rigid construction of the element outside the fastening zone comprises means for facilitating thermal expansion and contraction of said element without shingle breakage or disrupting a fastener disposed therethrough when the element is disposed on a roof in fastened engagement therewith, with a fastener through said zone.

2. The synthetic roofing element of a shingle or tile type of claim 1, wherein said at least one element fastening zone is at least partially formed in at least one of said top surface and said bottom surface.

3. The synthetic roofing element of a shingle or tile type of claim 2, wherein said element fastening zone formed in said top surface further comprises a drainage means for draining water therefrom.

4. The synthetic roofing element of a shingle or tile type of claim 1, wherein said element fastening zone with its plurality of ridges is corrugated, having a substantially uniform thickness.

5. The synthetic roofing element of a shingle or tile type of claim 1, wherein said element fastening zone with its plurality of ridges is corrugated, having a variable thickness.

6. The roofing element of claim 1, wherein the element is any one of:

(a) polymer based;

(b) fiber cement based;

(c) ceramic based; and (d) metal based.

7. The roofing element of claim 6, wherein the element is polymer based.

8. The synthetic roofing element of a shingle or tile type of claim 1, wherein said plurality of ridges are on the fastening zone bottom surface.

9. The synthetic roofing element of a shingle or tile type of claim 4, wherein said plurality of ridges are on only the fastening zone bottom surface.

10. The synthetic roofing element of a shingle or tile type of claim 5, wherein said plurality of ridges are on only the fastening zone bottom surface.

11. The synthetic roofing element of a shingle or tile type of claim 1, wherein said plurality of ridges are on only the fastening zone bottom surface.

12. The synthetic roofing element of a shingle or tile type of claim 11, wherein each indented fastening zone on the top surface is opposite the location of a plurality of ridges on the bottom surface.

* * * * *